United States Patent [19]

Bartholet et al.

[11] 4,424,963

[45] Jan. 10, 1984

[54] FINISHER—EXIT POCKET MODULE FOR COPIER

[75] Inventors: Michael A. Bartholet, Boulder; James L. Cochran, Longmont; Donovan M. Janssen, Boulder, all of Colo.; Robert Magno, Tucson, Ariz.; Allan J. Rood, Longmont, Colo.; William S. Seaward, Boulder, Colo.; Lance A. Walker, Longmont, Colo.

[73] Assignee: International Business Machines Corporation, Armonk, N.Y.

[21] Appl. No.: 301,335

[22] Filed: Sep. 11, 1981

[51] Int. Cl.[3] ..... B42B 2/00

[52] U.S. Cl. ..... 270/53; 414/73; 355/14 SH

[58] Field of Search ..... 270/37, 53, 58; 355/3 SH, 14 SH; 414/73; 227/39, 40, 43, 44, 45, 48, 50

[56] References Cited

U.S. PATENT DOCUMENTS

| | | | |
|---|---|---|---|
| 3,132,858 | 5/1964 | Bernard . | |
| 3,490,764 | 1/1970 | Muller . | |
| 3,709,595 | 1/1973 | Turner | 270/53 X |
| 4,027,873 | 6/1977 | Bishop | 271/197 |
| 4,134,672 | 1/1979 | Burlew . | |
| 4,248,413 | 2/1981 | Fox | 270/53 |
| 4,293,214 | 10/1981 | George | 270/53 X |
| 4,327,993 | 5/1982 | Gauronski | 355/3 SH X |

OTHER PUBLICATIONS

IBM Technical Disc. Bulletin; "Stapler Unloader for Copier"; Cralle et al.; vol. 18, #9; Feb. 1976.

*Primary Examiner*—A. J. Heinz

*Attorney, Agent, or Firm*—Carl M. Wright; J. G. Cockburn

[57] ABSTRACT

A compact single bin finisher adaptable to form collated sets of copy sheets outputted from a copier/duplicator. The finisher includes an output tray adapted to support the collated sets and to support copy sheets during accumulation of a set. A set accumulation module having an accumulation platform is disposed in a plane which is displaced both horizontally and vertically from the output tray. A transport device carries sheets into the accumulation module. A predetermined number of sheets form a set which may be stapled and is ejected onto the output tray.

9 Claims, 11 Drawing Figures

FINISHER—EXIT POCKET MODULE FOR COPIER

BACKGROUND OF THE INVENTION

1. Field of the Invention

The present invention relates to sheet handling devices in general and particularly to copy finishers adapted to forming collated sets of copy sheets, stapling the sets, and stacking the sets in an offset orientation on an output tray.

2. Prior Art

The use of finishers to form booklets or collated sets of copy sheets is well known in the prior art. Such finishers are usually coupled to a printer or copier/duplicator mechanism. As copy sheets are generated by the duplicator mechanism, the sheets are assembled into sets or booklets by the finisher. The sets are then stapled and are accumulated on an output tray.

U.S. Pat. No. 4,134,672 is an example of a prior art finisher. The finisher consists of an intermediate tray operable to accumulate a set of sheets. Usually the set contains a predetermined number of sheets. A jogger mechanism is coupled to the tray and forces the sheets into edgewise alignment. A stapler is disposed relative to the tray and, if selected, staples the sheets. A sheet transport device transports each set of sheets to an output table. The transport device is controlled so that complete stapled sets are stacked in an offset fashion on the output table.

U.S. Pat. No. 3,709,595 is another example of prior art finishers. The finisher includes a tray wherein sheets to be stapled are accumulated in aligned sets. The sets are stapled and ejected onto a separate output tray.

Although the prior art finishers may have worked satisfactorily for their intended purposes, certain drawbacks are noted. These prior art finishers use separate tables for forming sets and for stacking stapled sets. The utilization of two separate tables tends to unduly increase the size and cost of the prior art finishers.

SUMMARY OF THE INVENTION

It is therefore an object of the present invention to provide a more efficient finishing apparatus than has heretofore been possible.

It is also another object of the present invention to provide a miniaturized finishing apparatus.

The finishing apparatus includes a frame having a main body housing and a cover pivotally coupled to the main body housing. A sheet support bin is disposed within the main body housing. The bin is arranged in a general vertical orientation and is fitted with a movable bottom section and four side wall members. The side wall members extend upwardly from the bottom section. A sheet accumulation device is mounted to the main body housing. The accumulation device is laterally and vertically offset from the back wall of the support bin. A stapling device is mounted to the accumulation device. The stapling device is oriented so that the opening in which sheets are accumulated for stapling is in linear alignment with the accumulation cavity of the accumulation device. This orientation ensures that a set is accumulated simultaneously within the stapling device and the accumulating device.

Sheets to be stapled are conveyed by a vacuum transport mechanism which is mounted to the cover. The vacuum transport mechanism is angled relative to the accumulation deivce. The vacuum transport mechanism is fitted with stripping fingers which strip the sheets from the belt. The stripping action occurs after the leading edge of the sheet is securely clamped within the accumulation device. After a set of sheets is accumulated, it is stapled and ejected onto the support bin.

A sheet transport aligning mechanism couples the output copy sheet paper path of the copier with the vacuum transport mechanism. As sheets are outputted from the copier, they are aligned and delivered to the vacuum transport mechanism.

In one feature of the invention, a deflector device is disposed to deflect a sheet onto the vacuum transport mechanism or into an exit tray.

In another feature of the invention, a position adjustment mechanism is coupled to the stack support bin. The mechanism steps the bin so as to offset the stacks.

The foregoing and other objects, features and advantages of the invention will be apparent from the following more particular description of a preferred embodiment of the invention, as illustrated in the accompanying drawings.

DETAILED DESCRIPTION OF THE PREFERRED EMBODIMENT

Figure 1:
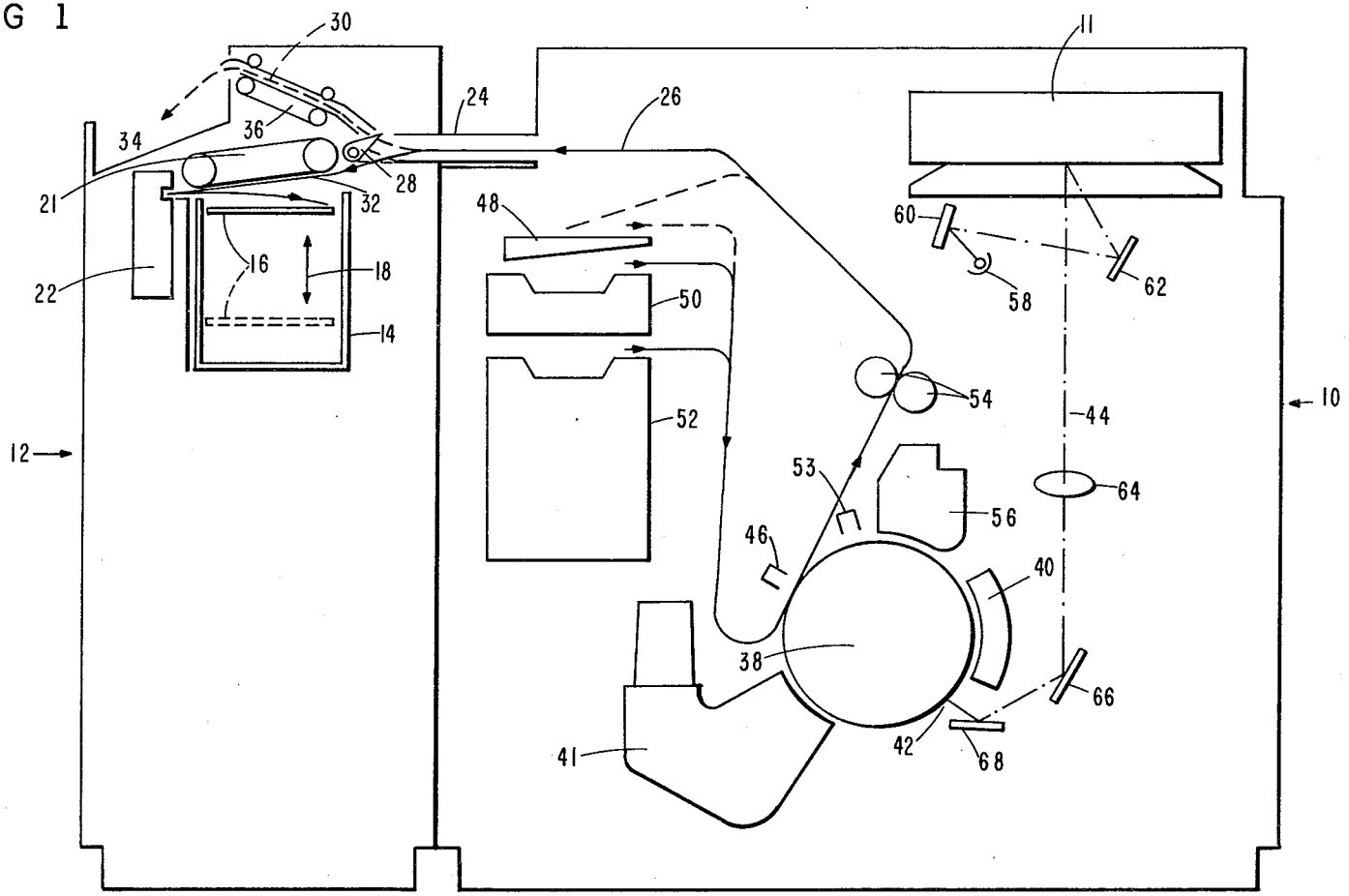
FIG. 1 is a front sectional view of an electrophotographic copier with a finishing device coupled to the copier housing.

In FIG. 1, there is shown an electrophotostatic copier 10 and a finishing apparatus 12. The finishing apparatus 12 is coupled to the copier system. The illustration of the finishing apparatus coupled to the copying system is only exemplary and does not create a limitation on the scope of the present invention. It is the intention of the inventors that the finishing apparatus be used in any environment and with any device wherein it is required to accumulate sets of documents, stapling them into booklets and forming collated sets.

To this end, the finishing apparatus 12 includes a frame member (not shown) upon which the functional elements of the finishing apparatus are coupled. The elements coact to perform the set accumulation function, the stapling function, and the offsetting function. The finishing apparatus 12 includes a set accumulation tray 14. The tray is disposed in a generally vertical orientation and includes a movable bottom section 16. The movable bottom section moves in a generally vertical plane in the direction 18, Similarly, the movable bottom moves from its lower position indicated by broken lines to its uppermost position indicated by solid line. As such, as stacks of stapled sheets are built up on the movable bottom 16, the bottom is adjusted to compensate for the height of the stack. Likewise, the stacks are offset by oscillating the set accumulation tray 14 in the direction perpendicular to the plane of the paper.

A set accumulation device and a stapling mechanism 22 are disposed in an offset position relative to the output tray 14. A vacuum transport device 21 is disposed at an angle relative to the set accumulation opening of the stapler and the set accumulation device. An intermediate sheet paper path 24, interconnects paper path 26 with the finishing apparatus 12. The intermediate sheet paper path 24 incorporates a sheet transport and aligning mechanism. A sheet deflection mechanism 28 is disposed to deflect sheets along an exit pocket path or nonfinishing path 30 or along a finishing path 32. An output tray 34 is disposed to accept sheets emerging from the nonfinishing path 30. Sheets are transported along the nonfinishing path 30 by a vacuum transport means identified by numeral 36.

In operation, as sheets emerge from copy sheet paper path 26, the sheets are aligned in the alignment and transport mechanism associated with intermediate sheet paper path 24. If the deflection mechanism 28 is placed in the down position indicated by broken lines in the figure, the sheets traverse the nonfinishing paper path 30 and are ejected in output tray 34.

If the deflection gate 28 is in the up position, the sheet traverses the finishing path 32. As the sheet traverses finishing path 32, it is attached to the lower run of the vacuum transport means 21. As the leading edge of the sheet is securely clamped in the sheet accumulation means, the sheet is stripped from the vacuum transport means. When a predetermined number of sheets are accumulated, the stapling mechanism drives a staple through the stack and the stack is ejected from the accumulation and stapling device onto the output tray. The tray is utilized to support a completed stack and to support a stack during formation. To compensate for stack height, the movable bottom of the tray is adjusted, and to offset the stack, the tray is oscillated in a direction perpendicular to the page.

The electrophotographic copier is arranged as a self-contained unit, having all of its processing stations located in a unitary enclosure cabinet. The processing stations include 38. The drum is mounted for rotation within the frame of said copier. A photosensitive layer is mounted to the outside surface of drum 38. A charging corona identified by numeral 40 is disposed relative to the photosensitive layer of said drum. An imaging station 42 is disposed downstream from the charging corona station in the direction of drum rotation. At imaging station 42, a latent image of a document which is transmitted along the light path 44 is formed on the photosensitive layer of the drum. The latent image on the drum is made visible by development station 41. At the development station, microscopic toner is transported to the drum. The areas of the drum which maintain a charge, develop a latent image.

Disposed downstream from the development station 41 in the direction of drum rotation, is the transfer corona 46. The function of the transfer corona is to transfer the developed image from the photosensitive surface of the drum to a copy sheet selected from the duplex paper tray 48 or the regular or alternate paper tray 50 and 52, respectively. The transfer image is fused at fusing station 54. The fused copy sheet exits the copier along paper path 26.

After transfer, the photoconductor is precleaned at preclean corona 53 and the residual toner is cleaned by the magnetic brush cleaning station 56. After cleaning, the photoconductor is ready for another cycle and the process is repeated. Original documents to be copied are positioned on the document glass of the electrophotographic copier 10 by a recirculating automatic document feed (RADF) 11. An illumination means 58 generates the light used to illuminate the document glass. Rays emitted from the illumination means 58 are reflected from mirrors 60 and 62, respectively, onto the document platen and through lens assembly 64 from which it is focused and reflected along mirrors 66 and 68, respectively, onto the photoconductor drum.

Finishing Apparatus

Figure 2:
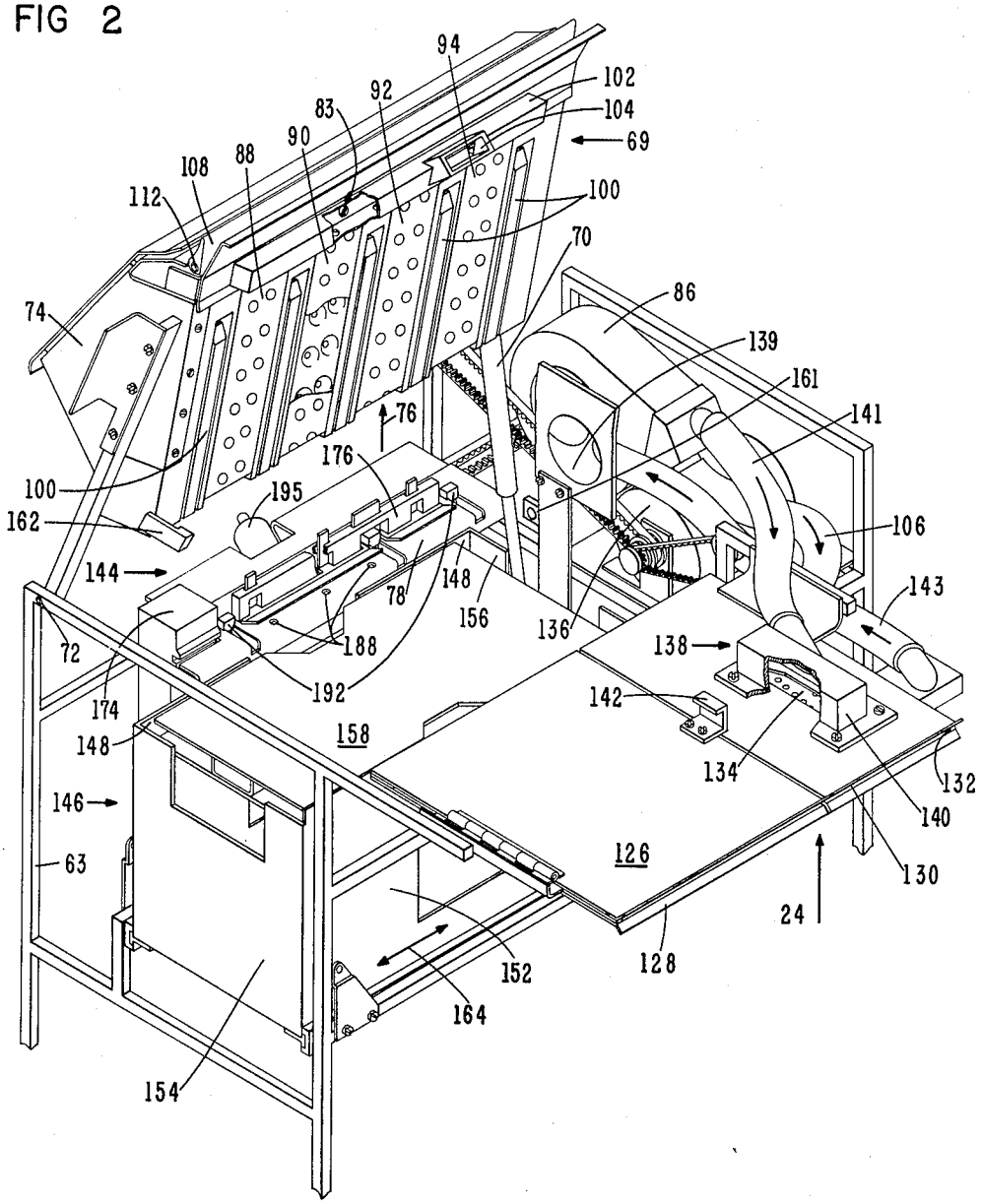
FIG. 2 is a perspective view of the finishing device according to the teaching of the present invention. The cover section of the device is raised in spaced alignment with the main body of the device.
Figure 3:
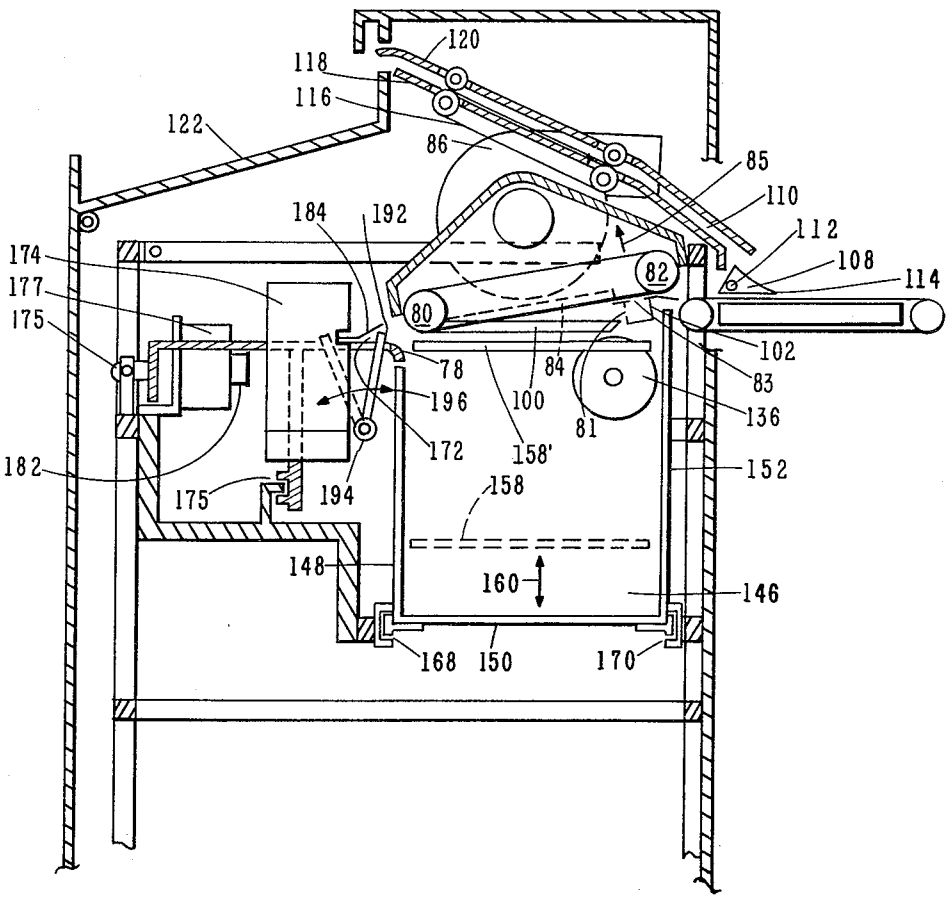
FIG. 3 is a side sectional view of the device with the cover section in the downward position.

The finishing apparatus 12 includes a frame having a main body housing section 63 and a cover section 69 (FIG. 2). For brevity of description, nonfunctional elements, such as covers, etc. are omitted from the drawings and will not be discussed in the detailed description. These nonfunctional elements can be designed by anyone having ordinary skill in the mechanical art, and as such, will not be described in detail. The stapling apparatus shown in FIGS. 2 and 3 are usually fitted with decorative covers. In FIGS. 2 and 3, the cover section 69 is pivotally coupled to the main body housing section 63 by a spring support rod 70. The cover section 69 can be extended into a pop-up configuration (partly raised) or a fully raised position. In the fully raised position, an operator can enter the finisher to remove jams. In either the fully raised position or the pop-up position, the cover section is supported by a support spring rod 70. The cover section pivots about hinge member 72 for the fully raised position or in the pop-up position.

In FIGS. 2 and 3, the cover section 69 includes a cover support frame 74. The function of the cover support frame 74 is to support the functional elements of the finisher which are attached to the cover support frame. The main functional element which is mounted to the cover support frame 74 includes a main document transport means 76. As is shown more clearly in FIG. 3, the main document transport means 76 is mounted to the cover support frame 74 so that when the cover section is in the closed position shown in FIG. 3, the bottom surface of the main document transport means is disposed at an angle to the accumulator platform 78. Although a plurality of document transport devices can be used to transport documents onto the accumulation platform, in the preferred embodiment of this invention, the main document transport means 76 is a vacuum transport belt device. The vacuum transport belt device includes a pair of cylindrical rollers identified by numerals 80 and 82 mounted to the frame 74. One of the rollers is driven by a motor and pulley arrangement while the other roller is utilized as an idler roller. A vacuum plenum 84 is disposed between the rollers. Vacuum to the plenum is supplied via a blower assembly 86. Details of the blower assembly 86 will be described hereinafter.

A plurality of perforated endless belts 88, 90, 92 and 94 are mounted in spaced relationship on the cylindrical rollers. A plenum stripper shaft (not shown) is mounted to the cover support frame 74. The shaft is oriented so that it runs parallel to cylindrical roller 80. A plurality of stripper arms 100 are mounted to the stripper shaft. The stripper arms are disposed in spaced relationship on the stripper shaft and are positioned between the plurality of endless belts. The bottom surface of the stripper arm recedes slightly above the lower surface of the endless belt. As will be explained subsequently, whenever a sheet (not shown) is tacked onto the undersurface or lower run of the belt and the leading edge of the sheet is positioned within the accumulation module, a solenoid mechanism, which is coupled to the stripper shaft, is activated whereupon the arms move downwardly below the bottom surface of the belt and strip the sheet therefrom.

In order to assist the stripping of the sheet, a blower box, 102 is mounted on the cover support frame. The box also assists to attach a sheet onto the vacuum transport belt. The box is fitted with two sets of holes 81 and 83 (FIG. 3). The holes in each set extend along the longitudinal axis of the blower box. Air escaping past the set of holes 83 blow upwardly in the direction shown by arrow 85. As a sheet is transported between the box and the undersurface of the belt, air escaping from the set of holes 83 forces the sheet against the belt. As the trailing edge of the sheet passes the box, air exiting from holes 81 blow between the back-side of the sheet and the belt and, as a result, aids in stripping the sheet from the belt. More particularly, the stripper arms 100 initiate the first peeling of the sheet from the plenum. The air from holes 81 backfills the area swept out by the sheet being stripped. It is therefore obvious that the holes which blow air perpendicular to the surface of the belt assist in attaching the paper against the belt. The holes which blow air tangential to the belt help to strip the sheet from the belt so that the box performs dual functions. The box is fitted with an input opening 104.

Air is supplied into the box through opening 104. The input opening 104 coacts with an opening (not shown) disposed in the intermediate paper path section 24 of the finisher. The opening (not shown) is coupled to blower assembly 86 via hose member 106. The arrows identify the direction of airflow in the hoses. It should be noted that when the cover section is down in the operative position, the opening 104 is in alignment with the opening (not shown) disposed in the intermediate paper path section 24.

A deflection means 108 is mounted to the cover support frame 74. The function of the deflection assembly 108 is to divert a sheet outputted from the copier duplicator mechanism 10 (FIG. 1) along a nonfinishing path 110 (FIG. 3) or along a finishing path where the sheet is conveyed by the main transport belt into the accumulator module. To this end, the deflection assembly 108 includes a deflection shaft 112 and a wedge-shaped deflection member 114 coupled to the shaft. A motion mechanism (not shown), comprising of a solenoid and mechanical linkage, is coupled to the shaft. In operation, depending on the mode of operation selected by an operator, the shaft and attached solenoid position the deflection member so that an operator can select either the finishing mode wherein the member is positioned to deflect a sheet onto the main transport belt or will deflect the sheet to traverse the nonfinishing path 110 (FIG. 3). A transport mechanism 116 is disposed along the nonfinishing path 110. In the preferred embodiment of this invention, the transport mechanism is a transport belt with back-up rollers. Of course, other types of transport mechanisms can be utilized without departing from the spirit or scope of the present invention. The nonfinishing path 110 is defined by a pair of guide members 118 and 120. The guide members are disposed in spaced relationship to define a channel or space therebetween. A nonstapling exit pocket module 122 is disposed at the exit of the nonstapling path 110. In operation, when an operator elects the nonstapling mode of operation of the device, a sheet exiting from the copier/duplicator is deflected along the nonstapling path 110 and is accumulated in the nonstapling exit pocket module.

Sheets which are to be delivered to the cover section 69 are transported through intermediate section 24. The function of the intermediate section 24 is to accept a sheet outputted from the copier/duplicator (FIG. 1), align the sheet, and deliver it to the main document transport means 76. To this end, the intermediate section 24 includes an intermediate paper channel defined by upper and lower channel members 126 and 128, respectively. The intermediate paper channel is aligned with the copy paper path 26 of the copier/duplicator (FIG. 1). As such, as a copy sheet exits the copier module, it enters the intermediate paper channel. In the intermediate paper channel, the sheet is first aligned and is then transported into the main paper transport of the finisher.

To this end, a side aligning member 132 is mounted to the intermediate section 24. A transport aligner 134 is disposed relative to the side aligning member 132. In the preferred embodiment of this invention, the aligner transport 134 is of the previously described vacuum transport type. This type of device has been previously described and its detail will not be repeated here. The transport includes vacuum belts which are skewed relative to the alignment edge so that sheets being transported on the belt are forced to contact the side aligning member 132 where they are driven into edgewise alignment. A common AC drive motor 136 supplies the motive force through adequate mechanical coupling to the skewed belt.

Oftentimes the copy sheets outputted from the copier/duplicator contain an unusual amount of moisture. This moisture tends to accumulate in the intermediate channel 130 and results in problems for the sheets transported in said channel. To alleviate this moisture problem, a dryer assembly 138 is fitted in the intermediate section 24. The dryer assembly 138 includes a closed box 140 which extends upwardly from the top surface of upper channel member 126. Positive pressure is supplied through hose 141 to the box. The positive pressure dries the moisture from channel 130. As a sheet (not shown) is transported on the vacuum transport belt, the positive pressure is above the sheet, thereby forcing the sheet onto the belt. By utilizing positive and negative pressure on opposite sides of a sheet, the sheet is tacked more securely to the transport belt 134. A handle member 142 is fitted to upper channel member 126. The function of the handle member 142 is to enable the lifting of the upper channel member. To clear a paper jam in the intermediate section, an operator utilizes the handle for lifting the upper section of the channel, thereby exposing the channel and its associated aligner transport mechanism. Sheets which are jammed are then removed.

Figure 11:
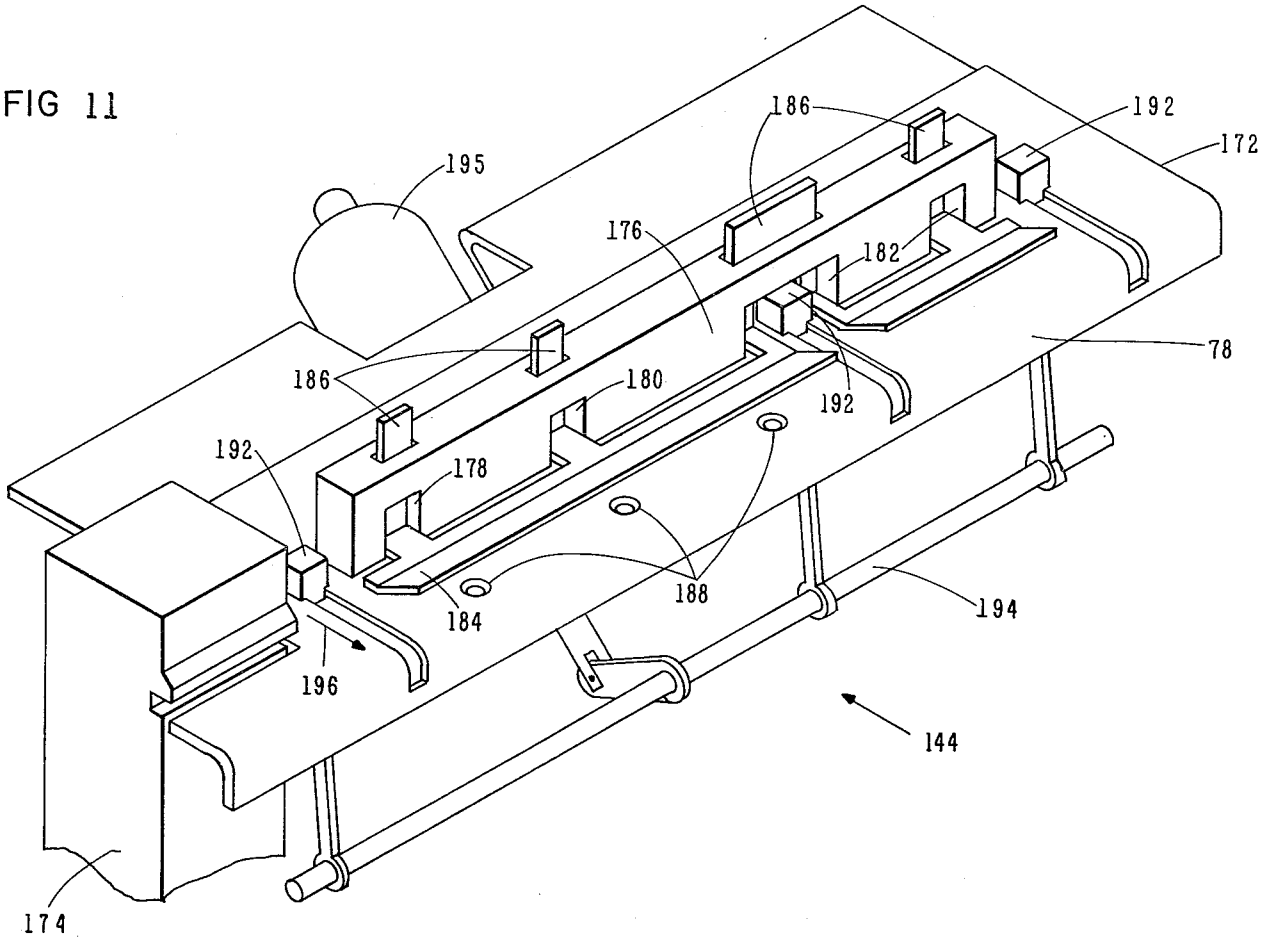
FIG. 11 is a perspective view of the accumulator/stapling module.

As shown in FIGS. 2, 3, and 11, the main body housing section 63 includes a stapler/accumulator ejection module 144 and a stack output tray 146. The stack output tray 146 is mounted to the frame of the main body housing section 66 and is oriented in a general vertical orientation. The stapler/accumulation ejection module 144 is oriented in a general horizontal position and is offset from side member 148 of the stack output tray module 146. With this orientation, the stack output tray 146 serves two functions, viz., it acts as the accumulation source for collated sets and supports the formation of a set.

The stack output tray assembly 146 includes a box-like structure having a bottom section 150 and a plurality of side members 148, 152, 154, and 156 extending upwardly therefrom. A movable platform 158 is disposed within the stack output tray assembly. The movable platform supports a stack comprising of a plurality of stapled sets and supports the sheets while a set is being formed. The platform is driven in a vertical path by a motor assembly (not shown). The vertical path is identified by a double-headed arrow 160. The platform is positioned at the top of the bin 158'. As stacks are formed on the platform, it is lowered until it is positioned in the lowermost point identified by numeral 158.

In order to adjust the position of the movable platform, a position sensing mechanism coacts with the movable platform to adjust its position. In the preferred embodiment of this invention, the position sensing device is of the reflective type sensor comprising of a light emitting source 161 (FIG. 2) and a light receiving source 162. The movable platform is controlled so that it is positioned singly or with load so that it is below the level of the light beam emanating from the light emitting source. In operation, the light is directed to the opposite surface of the tray. When the movable platform is properly positioned, the beam falls upon the light receiving source or sensor. The output of the sensor is at a constant level. However, when the beam is broken due to the fact that either the movable platform 158 or the load on the platform is positioned above the permissible level in the tray, the beam is broken and a control pulse is supplied from the sensing circuitry associated with the sensor. This signal is utilized by the controller to activate the elevation motor (not shown) and the platform is indexed to its permissible level.

Another function associated with the stack output tray assembly 146 is to offset the stacks as they are ejected from the accumulation module. To this end, the stack output tray assembly 146 is capable of moving in the direction shown by double-headed arrow 164. This motion also enables an operator to pull out the tray and to remove the documents which are loaded on the platform. To enable the offsetting function, the tray is stepped a fixed amount. Stepping occurs as soon as a stack of sheets is ejected onto the platform. This ensures that contiguous sets of sheets are stacked at offsetting locations. The stepping of the tray for a predetermined distance to provide the offsetting feature of the present invention is done by a DC motor coupled through suitable mechanical linkage to the tray. A detailed description of this assembly will be given hereinafter.

To effectuate the motion of the tray in the direction shown by arrow 164, the tray is coupled by carriage assemblies 168 and 170 to the support frame of the main body housing section. Each carriage assembly includes a track fixedly mounted to the frame and a ball bearing carriage assembly fixedly mounted to the tray. The tray and the attached ball bearing assembly slide along the track which is mounted to the frame of the main body housing section. With reference to FIG.3, the tray, including the movable platform and accumulated sets, can be moved by an operator in and out of the page or along the direction indicated by arrow 164 in the perspective view of FIG. 2. This enables an operator to remove collated sets from the tray.

As shown in FIGS. 2, 3 and 11, the stapler accumulation ejection module 144 comprises an accumulation module 172 and a stapling device 174. The stapling device is fixedly coupled to the accumulation device 172. The accumulation device 172 comprises of an accumulator platform 78. A back alignment member 176 extends upwardly from the accumulation platform 78. The function of the back aligning member 176 is to align copy sheets which are transported by the main transport. The main transport is coupled to the cover section of the finisher and is inclined relative to the opening of the accumulation device 172 in which sheets are accumulated. It should be noted at this time that the lateral alignment for the sheet is done by the aligner transport 134 (FIG. 2) prior to sheet delivery into the accumulation device. Once the sheet is laterally aligned, it is held into alignment while it is transported by the vacuum transport belt of the main transport 76 (FIG. 2). The back aligning member 176 is fitted with a plurality of holes 178, 180 and 182. A floating plate member 184 includes a flat elongated section and a plurality of pins 186 which extend upwardly above the flat elongated section. As is seen in the figure, the pins are loosely fitted in the openings 178, 180 and 182. As a result, the floating plate 184 moves in a plane perpendicular to the accumulation platform 78. As the number of sheets increases on the accumulation platform, the floating plate member moves upwardly and helps to form the accumulation opening in which sets are accumulated.

As stated previously, as sets are accumulated, the set is supported by the movable platform of the output tray assembly. In order to secure the sheets on the platform from premature ejection from the accumulation opening, a vacuum platen (not shown) is deposited on the underside of the accumulation platform. Negative pressure or vacuum is supplied through openings 188 (FIG. 2) to the surface of the platform. Therefore as the first sheet enters into the platform, it is held firmly on the platform by the vacuum exiting through opening 188.

The stapler device 174 can be any conventional stapler utilizing cut, preformed staples or using staples from a wire roll and preforming the staple to fit a particular thickness of paper within the staple housing. If the stapler utilizes wire, a wire support roll (not shown) is mounted to the accumulation module. Since stapling mechanisms for stapling sheets are well known in the prior art, a detailed description of the stapler 174 will not be given here. The stapler has a head section whose top surface is substantially on the same level or plane, i.e., is coplanar with the top surface of accumulation platform 78 and an anvil portion which is displaced from the head section. The anvil section and the head section are disposed to form an opening in which sheets are accumulated. The stapler is mounted so that the accumulation opening is in linear alignment with the stack of sheets which is accumulated in the accumulation opening formed by accumulation platform 78 and the floating plate member 184. With this arrangement, as soon as a stack is formed within the stack accumulation opening and if the stapling mode of operation is selected, the stapler, i.e., will staple fasten the stack of sheets and the stack will be ejected from the accumulation module by a plurality of ejectors 192.

The ejected set falls on the movable platform and, if the set exceeds the predetermined height, the movable platform is lowered. Likewise, as sets are ejected onto the movable platform, the tray assembly is stepped in a lateral direction so that the newly ejected set is offset from the previous set. As is shown more clearly in FIGS. 3 and 11, the ejecting mechanism 192 includes an ejection shaft 194. The shaft is mounted to the accumulation module of the finisher and is disposed below the accumulation platform. The shaft runs in the direction parallel to the direction of the accumulation platform. The ejectors 192 are fixedly coupled to the shaft. The ejectors are disposed so that they extend upwardly through openings in the accumulator platform 172. A solenoid mechanism is coupled to shaft 194. Following the completion and stapling of the set, the solenoid 195 is activated and the ejectors move forward in the direction shown by arrow 196 to eject a set from the accumulation module. The ejector position, shown in solid lines in FIG. 3, shows the ejector after it ejects a sheet from the accumulation module. Likewise, in the broken-line position, it is at the home position, waiting for a set to be accumulated prior to ejection.

As was stated previously, when the finisher is in its operating condition, the cover section is in the closed configuration wherein the vacuum belts of the main transport 76 (FIGS. 2 and 3) are disposed at an angle relative to the accumulation platform. As a result, as sheets traverse the lower run of the vacuum belts, the leading edge is forced onto the accumulation platform and alignment in the direction of sheet motion is provided by back aligning member 176. Lateral alignment is achieved prior to the delivery of a sheet to the main transport. The floating plate member 184 supplies a downward force on the sheet. The stripping of the sheet from the vaccum belts of the main transport is delayed until the leading edge of the sheet is securely clamped within the accumulation module. This type of operation ensures a smooth and orderly transfer of the sheet from the main transport belt. It also ensures that the lateral alignment which was done on each sheet by the aligner transport 134 is maintained.

Figure 4:
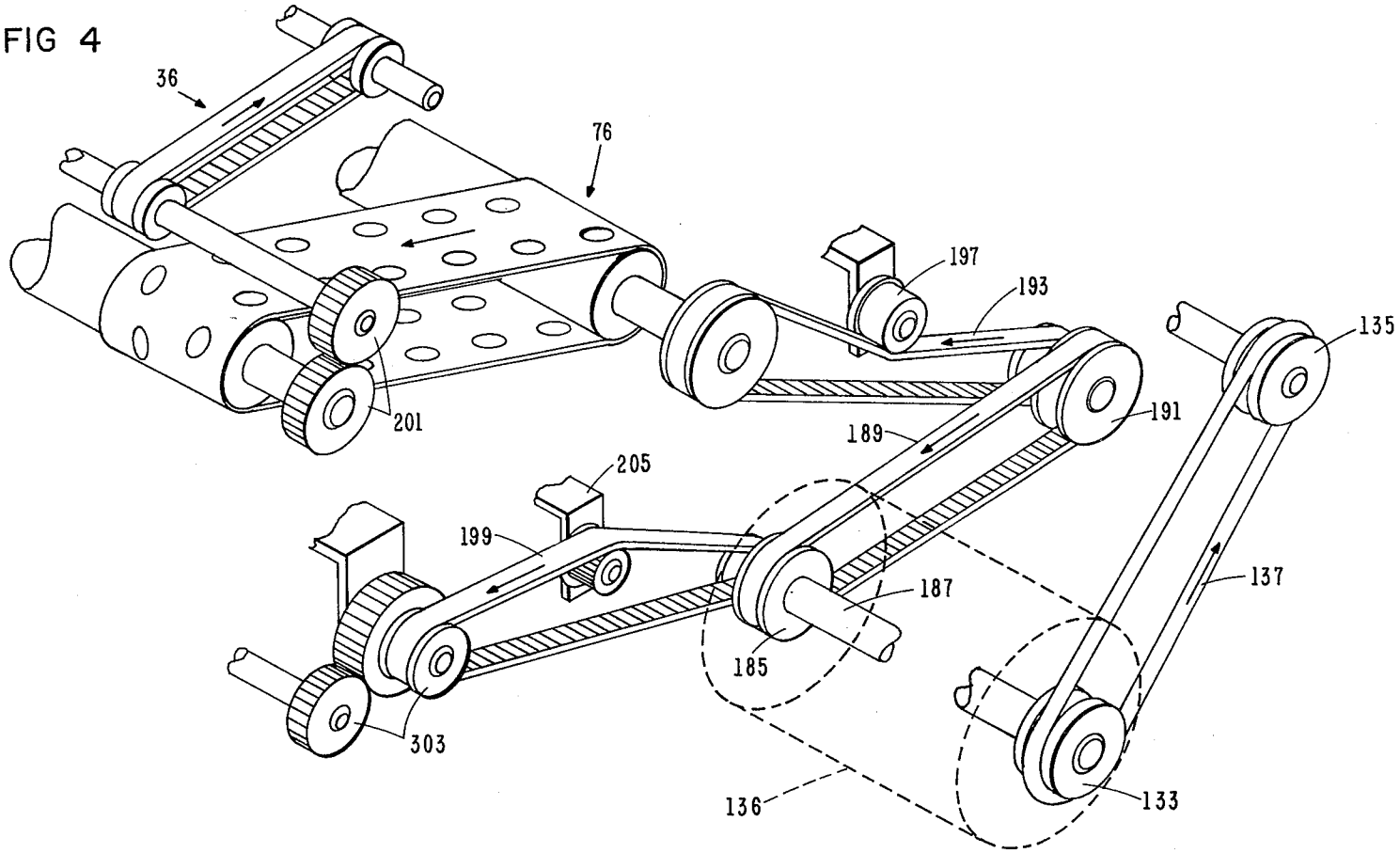
FIG. 4 is an illustration of the drive mechanism which supplies the motive force for various components of the finisher.

As was stated previously, the functional components of the finishing apparatus utilize both negative pressure (vacuum) and positive pressure to attach the sheets onto the transport belt of the system. In FIGS. 2, 3 and 4, the pneumatic system, which generates both negative and positive pressure for the system, is shown. The pneumatic system includes a blower assembly 86. The blower assembly is driven by the AC motor 136. The motor is coupled to the blower via pulleys 133, 135 and drive belt 137. One side of the blower assembly generates negative pressure (vacuum) while the other side generates positive pressure. A hole is positioned on the side of the blower which generates negative pressure. The hole coacts with another hole (not shown) which is positioned on the vacuum plenum of the main transport. When the cover section of the finisher is in the down position, the holes are in pneumatic communication. With motor 136 running, air is pulled from the plenum through hole 139. As a result, vacuum is supplied to the main transport. As was stated previously, the aligner transport 134 is of the vacuum belt transport type. Vacuum to the plenum (not shown) of said transport is supplied by hose 143. Hose 143 is coupled to the negative pressure side of the blower. Similarly, positive pressure is applied through hoses 141 and 106. The hoses are coupled to the positive pressure side of the blower. Thus, a single motor/blower assembly is utilized to generate both negative and positive pressure source.

Figure 6:
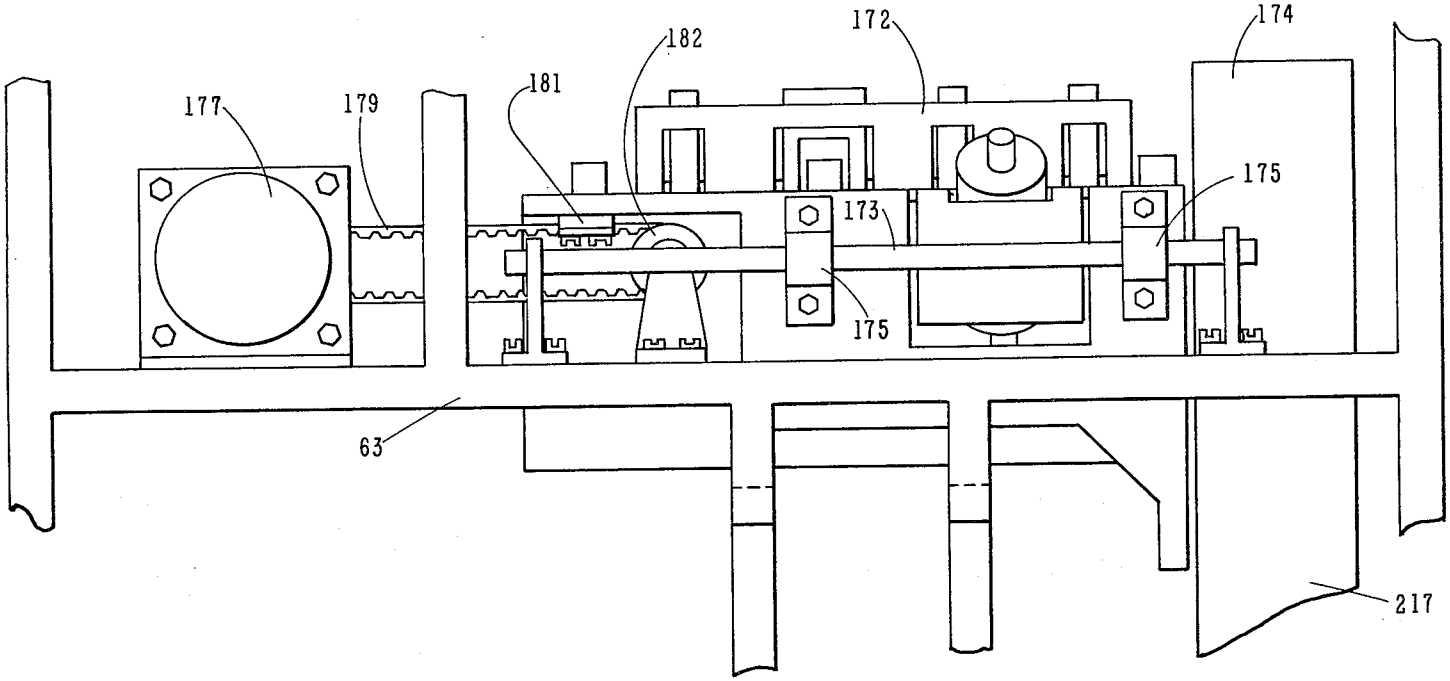
FIG. 6 is a motor and carriage assembly which adjusts the position of the accumulation module to compensate for variable length sheets.

FIG. 6 is a back view of the finishing mechanism. The view shows the mechanism which moves the accumulation module 172 and the stapler device 174. This enables the finisher to accumulate and to staple sheets having variable lengths. The stapler 174 and the accumulation module 172 are coupled to frame 63. An elongated shaft 173 is mounted to frame 63. A plurality of sliding devices, 175, couple the accumulation module and stapling device to the elongated shaft. A stepper motor assembly comprising of a stepper motor 177, a tooth drive belt 179 and an idler pulley 183 are mounted to the frame. A coupling mechanism 181 couples the toothed belt to drive the accumulation module/stapler device into position. When the stepper motor is energized, the accumulation module and attached stapler moves a predetermined distance to accommodate paper having a different length.

FIG. 4 is an illustration of the drive mechanism which generates the moving force for driving the various components of the finisher, and as such, transports the sheets therethrough. The motive force element is the motor 136. In the preferred embodiment of this invention, the motor is an AC motor. The motor is coupled through couplings such as gears, pulleys, belts, etc. to drive the blower assembly, the main transport 76 (FIG. 2), the aligner transport 134 (FIG. 3), and the nonfinishing exit transport 36 (FIG. 1). To this end, a double pulley 185 is coupled to the motor shaft 187. A pulley belt 189 interconnects pulley 185 to another double pulley 191. Double pulley 191 is coupled through pulley belt 193 to the main transport assembly 76. Tension in belt 193 is supplied by tensioning means 197. The tensioning means ensures that adequate tension is maintained in the pulley belt. The cover section pivots about pulley 191, therefore, the center-to-center distance on belt 193 does not experience any variation. The idler is for adjustment needed in initial setup and adjustment needed due to belt stretch, similar to tension adjustment pulley 205. A gearing assembly 201 couples the main transport to the nonfinishing exit transport 36. Pulley belt 199 and gearing assembly 303 couple the motor to the aligner transport 134. Tensioning arm 205 maintains tension in the belt 199. With the above configuration, when the motor is energized, the paper transport and blower assembly are placed into an operative mode.

Figure 5:
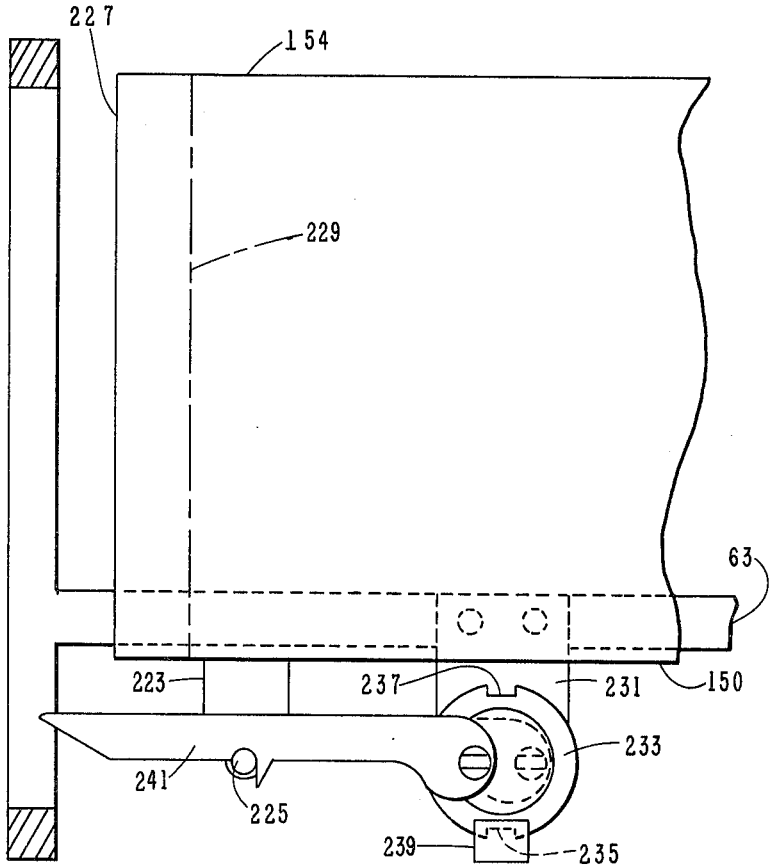
FIG. 5 is a line drawing of the mechanism used to reciprocate the set accumulation tray so as to offset the stacks.

FIG. 5 shows the mechanism used to reciprocate the drawer so as to offset the stacks.

In FIG. 5, there is shown an apparatus for adjusting the tray assembly 154 so that the sets are displaced, i.e., offset, relative to each other. A mounting bracket 223 is connected to the bottom section 146 of tray assembly 146. A pin 225 extends outwardly from the surface of mounting bracket 223. As will be explained subsequently, the pin coacts with a mechanical arm to move the tray from its normal position 227 to its offset position 229. A mounting bracket 231 is firmly mounted to the frame of the finisher. The mounting bracket supports a drive motor (not shown). A positioning plate 233 is firmly coupled to the shaft (not shown) of the motor. Two slots 235 and 237 are fabricated on the periphery of the plate. A sensing means 239 is positioned relative to the positioning plate. A mechanical arm 241 is coupled by a pin to the plate. The other end of the arm is fitted with a slot and the pin 225 which extends outward from mounting bracket 223 rides in the slot. In operation, when the motor (not shown) is energized, the positioning plate 233 rotates on the motor shaft. Simultaneously with the plate rotating on the motor shaft, the mechanical arm 241 pulls the tray assembly 154 along a linear path. When one of the slots on the positioning plate is positioned relative to sensor means 239, a signal is generated to deactivate the drive motor. As a second set of sheets is deposited on the movable platform, the motor is again energized and the plate rotates. As soon as the other slot is positioned relative to the sensor means 239, another signal is generated which stops the motor and indicates the second offset position. It can be seen that the two slots on the periphery of the positioning plate indicate the relative offset position for the tray and the stapled sets which are deposited thereon.

Figure 7:
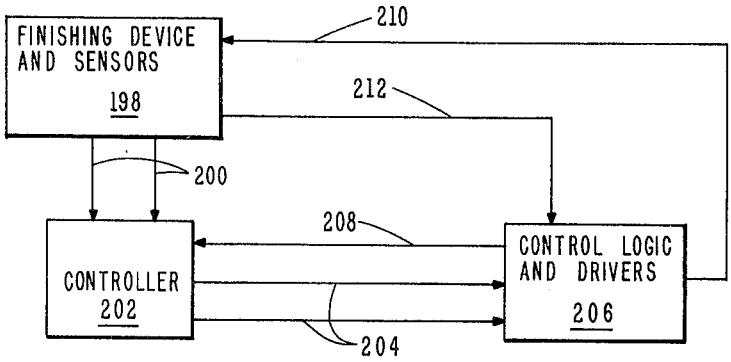
FIG. 7 is a block diagram of an electrical system for controlling the finishing device.

In order to achieve a reliable operation of the above-described finishing apparatus, a controller and control logic circuit generate electrical pulses which energize the various electrical elements or apparatus. FIG. 7 is a block diagram of the finisher and associated controller/logic circuits. The finisher device and sensors associated therewith are identified by numeral 198. Electrical signals supplied from the sensors are transmitted over conductor 200 to controller 202. Although combinatorial logic can be designed to form controller 202, in the preferred embodiment of the present invention, controller 202 is a microcomputer preferably the 6502 Microcomputer, manufactured by Motorola Corporation Inc. Of course, any other type of conventional microprocessors can be used to drive the finishing device to perform the necessary function. The control signals outputted from controller 202 are fed over conductors 204 into control logic driver circuit means 206. Signals from the control logic and driver circuit means 206 are fed over conductor 208 into controller 202. The output signals from control logic and driver circuit means 206 are fed over conductor 210 into the finishing device and sensors identified by numeral 198. Likewise, signals from the sensors associated with the finishing device are provided over conductor 212 into the control logic and driver circuit means 206.

Before describing the various electrical circuits and sensors utilized to control the finishing device, it is worthwhile noting the function which the device must perform.

The first function is primarily a counting function. The apparatus must be able to count the sheets as they are outputted from the paper path of the copier to generate a set of sheets having a predetermined count or number. Usually, the number of sheets in a set is sensed by the RADF. Alternatively the accumulator may utilize a sensing device which generates a signal when the number of sheets in the accumulator reaches a maximum.

As was stated previously, sets are accumulated by stacking sheets which are transported ad seriatim on the transport belts 88-94 (FIG. 2). As the leading edge of a sheet is clenched within the accumulation means comprising the accumulation platform 78 (FIG. 11) and floating plate 184, each sheet must be stripped from the belt by stripper arms 100 (FIG. 2).

Once a set having a predetermined number of sheets is accumulated in the accumulation means, the set is stapled by stapler 174 (FIG. 2).

The stapled sets are next ejected by ejectors 192 onto movable platform 158. Once a set is ejected on the platform, the platform is stepped downwardly a predetermined distance. The tray is then stepped laterally a predetermined amount to offset the adjoining set to form alternate collated sets.

In order to effectuate the above process steps, a plurality of sensors (not shown) are disposed along the intermediate section or sheet entry station 24 of the finisher. In the preferred embodiment of this invention, the sensors are microswitches. These sensors are utilized for counting sheets as they are outputted from the copier copy sheet paper path and are utilized in performing other functions such as jam detection, etc.

Another set of sensors is disposed on the main transport mechanism 76. The signals from these sensors are utilized to generate the timing signal which actuates the solenoid which moves the stripper arms 100 to strip a sheet from the main transport. In the preferred embodiment of this invention, the sensor is of the reflective type. Another set of sensors 162 (FIG. 3) are disposed on the sides of the output tray. As stated previously, these sensors are utilized to adjust the position of platform 158. A plurality of electromechanical devices, such as motors, solenoids and mechanical couplers, are utilized to drive the various mechanical components of the finishing device. An AC motor 136 drives the transport aligner 134, the main transport 76, and blower 86. Motor 177 is utilized to drive the stapling module so that it can adjust to accommodate sheets having variable length. The stapling device is energized by a separate motor 217 (FIG. 6). The stapler clincher is energized by a solenoid (not shown). A solenoid (not shown) is coupled to the deflection assembly 108. When the solenoid is activated or energized, sheets will accumulate in exit pocket 122 (FIG. 3). In its nonenergized state, it is springloaded so that sheets will traverse the stapling collate path. The ejector which ejects sets from the accumulation means is activated by a solenoid. Finally, separate DC motors are utilized for driving the tray assembly to offset stacks and for driving, i.e., elevating or lowering, output tray 146.

In order to perform the sheet counting, stapling, stripping, ejection, downward indexing and offsetting functions, the microprocessor is programmed utilizing the following macro steps:

STEP 1

Count the sheets as they exit singly from the copier. As a sheet is sensed, the count is compared to the total number of sheets which are needed to compile a set. The number of sheets for a set is automatically sensed by the RADF.

STEP 2

A delay module is then introduced in the program.

STEP 3

The stapling function is the performed.

STEP 4

A delay module is introduced into the program.

STEP 5

The set is ejected from the accumulation means onto the tray. The tray is indexed downwardly. This completes the process steps performed by the microprocessor.

Figure 8:
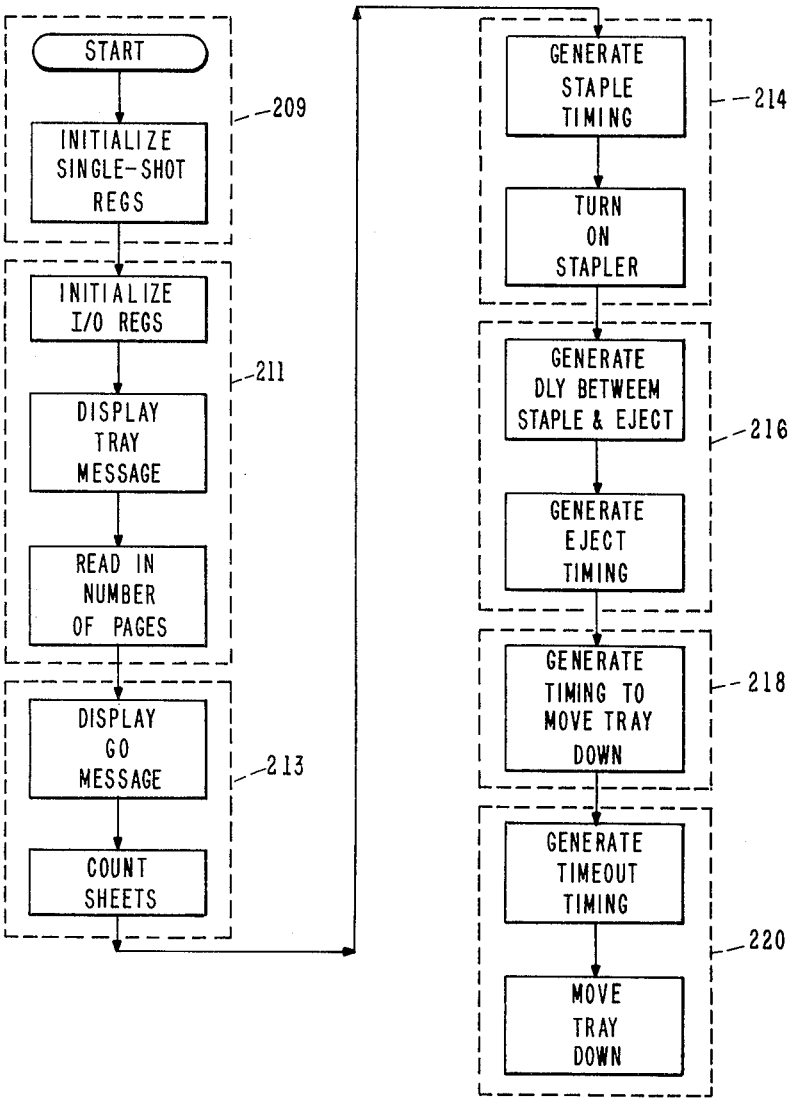
FIG. 8 is a flowchart which generates control signals for driving the finishing device.

In FIG. 8, a flowchart shows a more detailed series of process steps. The flowchart includes a plurality of subroutines which are executed to drive the microprocessor that control signals are generated to perform the necessary functions for controlling the finisher. Of course, there are other state-of-the-art approaches for programming the microprocessor without departing from the scope of the present invention. The first module 209 is the initialization module. The function of this module is to set up the internal registers of the microprocessor. Some of these registers are identified as a single shot register, etc.

The next module 211 is a set-up module. In this module, I/O registers associated with the microprocessor that are utilized by external devices are initialized, i.e., cleared. The movable platform is positioned so that it is in its uppermost position. As was stated before, the positioning of the platform is controlled by the tray sensors associated therewith. This module is also senses the switches which inform the microprocessor of the number of sheets or pages per set.

The next module 213 is the count module. The function of this module is to count the sheets as they are outputted from the copier/duplicator into the finishing device. The module is also used to display a message that the finisher is ready.

The next module 214 is the staple module. The function of this module is to activate the stapler for stapling a set of sheets. To this end, the module generates the staple timing and turns on the stapler motor. The next module 216 is the eject module. In this module, a delay (DLY) is initiated between the stapling function and the time when the set is ejected. The delay is such that it gives ample time for the stapler driving head to clear the set.

In the next module 218, timing is generated to move the tray downward.

Module 220 is the time-out module. This module generates the time-out function and at the end of this time-out period, if no sheet is sensed along the paper path, the microprocessor turns off the finishing device. The use of microcomputers for driving mechanical devices is well known in the art. Therefore, it is submitted that given the above-described flowchart and the function which is desired to be performed, anyone having ordinary skill in the art of programming can generate a general program which will drive a conventional microprocessor to perform the above function. It should also be noted that other series of process steps can be utilized by those having ordinary skill in the art for driving the microprocessor without diverting from the scope of the present invention.

Figure 9:
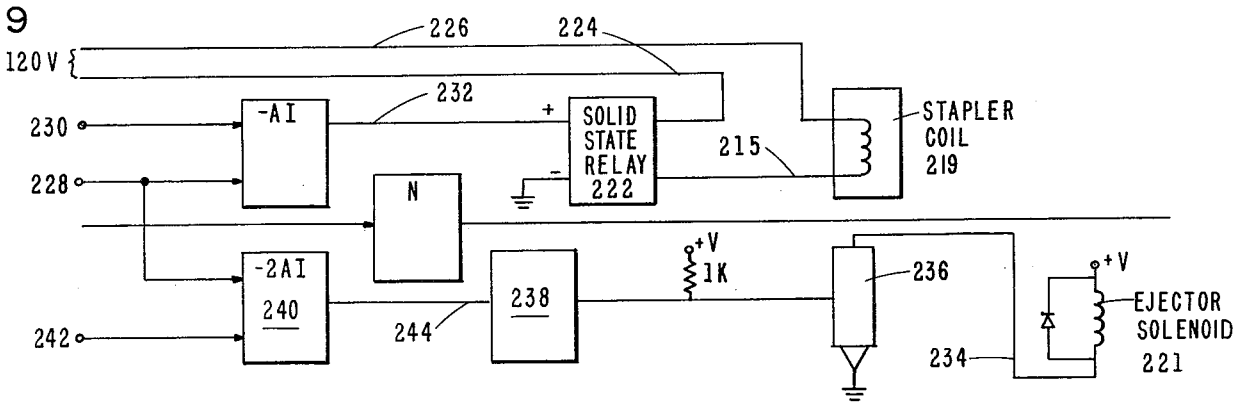
FIG. 9 is a schematic of a circuit for driving the ejector solenoid and the stapler solenoid.

Sometimes the signals which are outputted from the microprocessors must be converted before they can be used for driving an electromechanical device. Likewise, signals which are generated by outside electromechanical devices, such as switches, sensors, etc., have to be converted before they can be utilized by the microprocessor. To this end, the control logic and driver circuit block shown in FIG. 7 is utilized to convert the various signals. Electrical circuits for driving electromechanical components, such as motors, solenoids, etc. are well known in the prior art so details of these driving circuits will not be given here. By way of example, FIG. 9 shows a combinational circuitry which is utilized to drive the stapler solenoid and the ejector solenoid; it is within the skill of the art to generate other circuits without departing from the scope and spirit of the present invention. To enable the stapling function, the stapler is driven by a solenoid. Of course, other types of devices, such as motors, etc., can be used to drive the stapler. To activate the solenoid, one end of the stapler coil 219 is coupled over conductor 215 into one terminal of a solid state relay 222. In order to energize the solenoid, an AC voltage in the range of 120 volts is generated across the coil. To this end, the other end of the coil is coupled to a 120 volt AC source. This 120 volt AC power is supplied over conductors 224 and 226. It should be noted that the solid state relay device is a commercially available device which accepts a DC activating signal and drives an AC load. Such devices are well known in the prior art and therefore will not be described. The negative input of device 222 is grounded while the positive input is coupled to the output of a negative AND-INVERT (-AI) circuit means. The input to the negative AND-INVERT circuit means is a single short output signal on conductor 228 and a controlled enabling signal on conductor 230. It should be noted that the single shot control signal on conductor 228 is generated from the microprocessor.

In operation, the negative enabling signal is on conductor 230 simultaneously with the negative single shot output signal on conductor 228. Both signals are utilized by the negative AND-INVERT block and a positive signal is outputted on conductor 232. This signal energizes the solid state relay 222 which generates the appropriate voltage across the coil of the stapler and, as a result, a stack of accumulated sheets is stapled.

Similary, one terminal of the ejector solenoid is coupled to a positive supply source. A diode 221 is connected across the solenoid. The other terminal of the solenoid is coupled over conductor 234 to a transistor driver 236. The emitter of the transistor coupled to ground and the base of the transistor is coupled to a positive supply voltage through a 1K-ohm resistor. A buffer drive circuit 238 couples the base of the power transistor to a two-way AND-INVERT circuit means 240. One input to the circuit means 240 is from the single shot module generated from the microprocessor. The other enabling signal is a control signal on terminal 242. With both conductors 228 and 242 active, the control signal is outputted on conductor 244. The signal is buffered and then turns on the power transistor which in turn forces current to flow unilaterally in the ejector solenoid, and consequently a stapled set is ejected from the accumulation means. As stated before, it should be noted that circuits in FIG. 9 are exemplary and it is within the skill of the art to generate other conventional circuits for driving the stapler and the ejector solenoid without departing from the scope of the present invention. A similar circuit can be used to energize the ejector associated with the main transport.

Figure 10:
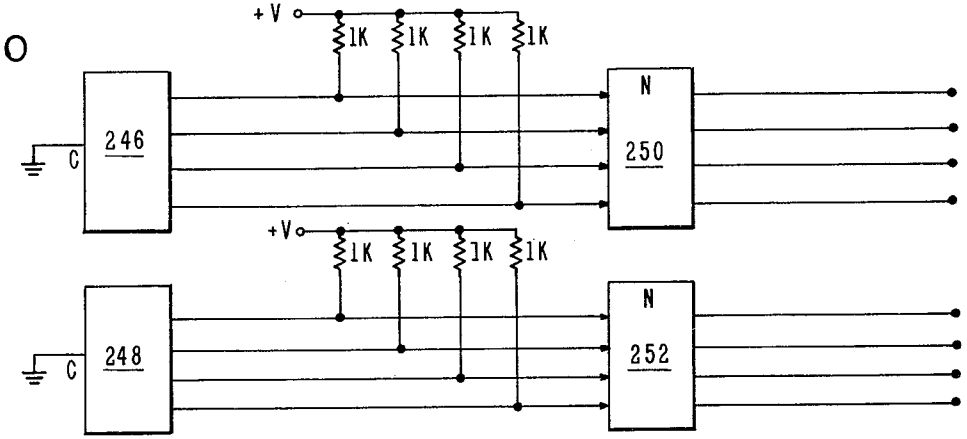
FIG. 10 is a schematic of an electrical circuit to convert switch selection to microprocessor utilization form.

In FIG. 10, a set of combinatorial logic is shown which converts the number of sheets per set selected by an operator into a form which can be utilized by the microprocessor. The circuits 246 and 248 are integrated circuit packages. Essentially, the input from the switches are coupled to these integrated which change the analog character of the switches into a digital form. By way of example, the signals which are inputted into integrated circuit package 246 identify units, while those inputted into 248 identify tens. Each of the circuits is fitted with a common terminal identified by C which is grounded. The output from each terminal is coupled to a positive supply voltage through a plurality of 1K-ohm resistors. The outputs are then fed into inverter circuit means 250 and 252. The output from these inverter circuit blocks are then digital bits which can be utilized by the microprocessor in setting up the number of copies which are needed for a set. Communication between the microprocessor and the electromechanical devices is achieved via I/O registers.

While the invention has been particularly shown and described with reference to a preferred embodiment thereof, it will be understood by those skilled in the art that various changes in form and details may be made therein without departing from the spirit and scope of the invention.

What is claimed is:

1. In an apparatus for receiving, finishing, and stacking document sheets in finished sets, the combination comprising:

accumulator means for accumulating successively received sheets into sets for finishing;

transport belts having negative pressure supplied thereto to hold said sheets on the belt for receiving individual sheets in succession and for inserting from a given direction said individual sheets into said accumulator means;

push-down arms pivotally mounted at one end and disposed adjacent and parallel to said transport belts for disengaging said sheets from said transport belts onto said accumulator means when actuated;

stacker means disposed adjacent said accumulator means for supporting accumulated sheets and for stacking finished sheets; and ejector means for moving finished sets from said accumulator means onto said stacker means in a direction opposite from said given direction.

2. The invention claimed in claim 1 wherein:

said accumulator means includes clamp means for holding inserted sheets in place until moved by said ejector means.

3. The invention claimed in claim 2 wherein said clamp means comprises a weighted member movably mounted in a vertical direction for supplying vertical pressure along a portion of the leading edge of said inserted sheets; and a fixed member fixedly mounted for supporting said inserted sheets under said leading edge portion.

4. The invention claimed in claim 1 wherein:

said accumulator means includes means for fastening together the sheets comprising a set.

5. The invention claimed in claim 4 wherein said fastening means comprises a stapler.

6. The invention claimed in claim 1 wherein said stacker means comprises platform means for supporting finished sets, and means for controlling the height of said platform to keep the uppermost surface of the top finished set, or the platform, in the case of no finished sets, positioned substantially at the level of said accumulator whereby said uppermost surface supports the weight of sheets in said accumulator.

7. The invention claimed in claim 1 wherein said ejector means comprises pusher means disposed, when inactivated, adjacent the leading edge of sheets received in said accumulator means for moving, when activated, finished sets from said accumulator means onto the stacker means.

8. An apparatus for receiving, finishing, and stacking document sheets in finished sets comprising, in combination:

accumulator means for accumulating successively received sheets into sets for finishing, said accumulator means including clamp means for holding inserted sheets in place until moved comprising an elongated weighted member slidably mounted in a vertical direction for applying vertical pressure gravitationally along a leading edge of said inserted sheets and a fixed member fixedly mounted for supporting said inserted sheets under said leading edge;

stacker means disposed adjacent said accumulator means for supporting accumulated sheets and for stacking finished sets, said stacker including platform means for supporting finished sets and means for controlling the height of said platform to keep a support surface positioned at approximately the level of said accumulator means' fixed member whereby said surface supports the weight of the sheets stacked in said accumulator;

transport means for receiving individual sheets in succession and for inserting said individual sheets in said accumulator means, said transport means including vacuum belt means having negative pressure supplied thereto to hold the sheets on the belt for transporting said sheets and push-down arm pivotally mounted adjacent said vacuum belt means for disengaging away said sheets from said vacuum belt means toward said stacker means when the leading edge of a transported sheet has been inserted into the clamp means of said accumulator means; and ejector means for moving finished sets from said accumulator means onto said stacker means in a direction opposite from that in which said sheets were inserted into the said accumulator means, said ejector means including pusher means disposed, when inactivated, adjacent the leading edge of sheets received in said accumulator means, for moving, when activated, finished sets from said accumulator means onto the stacker means.

9. The invention claimed in claim 8 wherein said accumulator means includes means for fastening together the sheets comprising a set.

* * * * *

UNITED STATES PATENT AND TRADEMARK OFFICE

CERTIFICATE OF CORRECTION

PATENT NO. : 4,424,963

DATED : January 10, 1984

INVENTOR(S) : M. A. Bartholet et al.

It is certified that error appears in the above—identified patent and that said Letters Patent is hereby corrected as shown below:

Column 1, line 68, delete "deivce" and insert --device--.

Column 2, line 40, after "a" insert --line drawing of a--.

Column 2, line 59, delete "system" and insert --10--.

Column 3, line 30, delete "identified by numeral".

Column 3, line 54, after "copier" insert --10--.

Column 3, line 57, after "include" insert --an electrophotostatic drum--.

Column 6, line 50, delete "Oftentimes" and insert --Sometimes--.

UNITED STATES PATENT AND TRADEMARK OFFICE

CERTIFICATE OF CORRECTION

PATENT NO. : 4,424,963

DATED : January 10, 1984

INVENTOR(S) : M. A. Bartholet et al.

It is certified that error appears in the above—identified patent and that said Letters Patent is hereby corrected as shown below:

Column 9, line 7, delete ",i.e.," and after "staple" insert --,i.e.,--.

Column 12, line 68, delete "the" and insert --then--.

Column 13, line 14, after "processor" insert --so--.

Column 14, line 33, after "is" insert --supplied--.

Column 14, line 45, after "transistor" insert --is--.

Column 15, line 2, delete "integrated" and insert --circuits--.

Claim 8, line 30, after "stacker" insert --means--.

Signed and Sealed this

*Twenty-first* Day of *May 1985*

[SEAL]

*Attest:*

DONALD J. QUIGG

*Attesting Officer*

*Acting Commissioner of Patents and Trademarks*